US005692369A

United States Patent [19]

Braun

[11] Patent Number: 5,692,369

[45] Date of Patent: Dec. 2, 1997

[54] ROTOR DISK FOR A SPINNING MACHINE

[75] Inventor: Otmar Braun, Frielendorf, Germany

[73] Assignee: Firma Carl Freudenberg, Weinheim, Germany

[21] Appl. No.: 521,484

[22] Filed: Aug. 30, 1995

[30] Foreign Application Priority Data

Oct. 18, 1994 [DE] Germany ..... 44 37 182.9

[51] Int. Cl.[6] ..... D01H 1/24; D01H 7/46

[52] U.S. Cl. ..... 57/339; 57/112; 57/406

[58] Field of Search ..... 57/406, 407, 337, 57/338, 339, 112; 29/894.2, 894.32; 384/549

[56] References Cited

U.S. PATENT DOCUMENTS

| | | | |
|---|---|---|---|
| 797,779 | 8/1905 | McCan | 301/84.4 |
| 2,599,176 | 6/1952 | Henry | 152/327 |
| 3,885,378 | 5/1975 | Schuster | 57/339 |
| 3,901,011 | 8/1975 | Schuster | 57/339 |
| 4,153,303 | 5/1979 | Tanner | 301/64.7 |
| 4,297,837 | 11/1981 | Bauer et al. | 57/337 X |
| 4,718,226 | 1/1988 | Schuster et al. | 57/337 X |
| 4,890,942 | 1/1990 | Raasch | 57/406 X |
| 4,893,946 | 1/1990 | Tesh et al. | 384/549 |
| 5,117,885 | 6/1992 | Crawford | 152/323 |
| 5,168,774 | 12/1992 | Andra et al. | 74/574 |
| 5,221,133 | 6/1993 | Braun et al. | 384/549 |
| 5,362,160 | 11/1994 | Braun et al. | 57/406 X |
| 5,399,028 | 3/1995 | Raasch | 384/549 |
| 5,423,616 | 6/1995 | Götz | 57/407 X |

FOREIGN PATENT DOCUMENTS

| | | | |
|---|---|---|---|
| 42 29 154 | 3/1994 | Germany . | |
| 2008044 | 5/1979 | United Kingdom | 301/64.3 |

*Primary Examiner*—William Stryjewski
*Attorney, Agent, or Firm*—Kenyon & Kenyon

[57] ABSTRACT

A rotor disk for a spinning machine has a hub ring that includes a first carrier and a second carrier, with the hub ring being joined radially externally in a rotationally fixed manner to a thrust ring made of polymer material. The hub ring and the thrust ring are fastened together in a manner allowing them to be detached non-destructively. The first and the second carriers are constructed and are arranged in a mirror image.

11 Claims, 3 Drawing Sheets

ROTOR DISK FOR A SPINNING MACHINE

BACKGROUND OF THE INVENTION

The present invention relates generally to a rotor disk for a spinning machine and, more particularly, to a rotor disk having a thrust ring that can be non-destructively detached from the hub ring.

German patent 42 29 154 A1 (corresponding to U.S. Pat. No. 5,399,028, which is incorporated herein by reference) discloses a support disk assembly for rotatable mounting to form a bearing for a spinning rotor. The support disk assembly has an interchangeable annular collar. The annular collar is fastened between two fastening rings extending in the radial direction, each of the fastening rings having claws in the area of its radially outer boundary that extend to one another in the axial direction. The annular collar is arranged between the two fastening rings with only a slight axial pressure in order to avoid a deformation of the annular collar in the radial direction and the unsatisfactory rotational properties resulting from it. The two fastening rings differ in shape and are fastened together. Such an arrangement is not very satisfactory with regard to the manufacturing expense of the support disk assembly.

This invention is directed to the problem of producing a rotor disk having a hub ring that can be more easily and more cost-effectively manufactured.

SUMMARY OF THE INVENTION

The present invention solves this problem by providing a rotor disk having a hub ring with two opposed, identical carriers. The first and the second carriers are identically constructed and are arranged in a mirror image. An advantage of using two identically constructed carriers is that only one tool is needed to produce the two carriers. The two identically constructed carriers are assembled, with the intermediate joining of the thrust ring, to form the hub ring. This arrangement permits the non-destructive detachment of the thrust ring from the hub ring. Possible errors in the assembly of the hub ring are reduced to a minimum by the embodiment according to the present invention in which the thrust ring is inserted between the two mirror-image carriers. The two carriers preferably are made of a polymer material with an elastic modulus of 17 GPa to 20 GPa, a maximum elongation of 1.8% to 2.4% and dimensional stability within the temperature range of 150° C. to 250° C.

Another embodiment of the present invention provides for the carriers, when assembled, in the area of their periphery, to jointly form the boundary of a grooved and undercut opening for receiving the thrust ring, and for the thrust ring, having at least one hammer-head-shaped projection pointing radially inwardly, to be arranged in the opening with form locking and under elastic prestressing. The undercut opening preferably has a circular design on the peripheral side and it receives the correspondingly shaped projection in a form-locking manner with prestressing. The thrust ring is preferably made of polyurethane having a high scuff resistance which therefore brings about good working properties of the entire rotor disk during a long service life. The thrust ring may be produced by injection molding.

The two identically constructed carriers have an essentially C-shaped cross-section and contact one another in the area of their radial projections. The hub ring having only the two carriers is designed essentially with a double T shape. In this connection, it is an advantage that the hub ring has a very high rigidity in the radial direction since the mutually contacting carriers support each other. Even when the rotor disk is stressed relatively heavily in the radial direction, excellent rotation of the disk is assured because of the inflexible form of the hub ring.

The two carriers can be made, for example, of a polymer material. In this regard, it is an advantage that, because of the mutual bracing of the carriers against each other, the hub ring has great inherent stability with very low weight and low mass inertia. In light of the rapid and precise speed variation of the rotor disk, these advantages are very important.

The first and the second carriers can be held together by means of a fixing device. Depending upon the desired application, various fixing devices can be used. For example, the fixing device can be formed only by the thrust ring itself, or by a clip-connection constructed in one piece with the carriers. If, for example, a plurality of rotor disks braced against each other in the axial direction are used, the utilization of secondary fixing aids is unnecessary. The two carriers are held by the bracing and the thrust rings themselves.

On the other hand, if the carriers are pressed onto a shaft, it is necessary that the carriers be joined together by means of a fixing device in order to avoid relative displacements in the axial direction. Preferably a clip-connection is used.

In another embodiment of the present invention, the surface areas of the carriers bordering the undercut opening may have knob-shaped protuberances which act as an anti-rotation element. A twisting of the hub ring relative to the thrust ring in the circumferential direction is prevented with such a refinement even when comparatively high torque is to be transferred with slight bracing of the projection in the opening. The supporting disk and the carriers are joined together with form locking in the area of the undercut opening in the joined carriers.

The rotor disk is used preferably as a texturing disk. In texturing, extruded threads run across the thrust ring and in so doing are, for example, roughened and/or stretched.

Additional applications are also possible, for example as a supporting disk of an open-end spinning machine.

DETAILED DESCRIPTION

Figure 1:
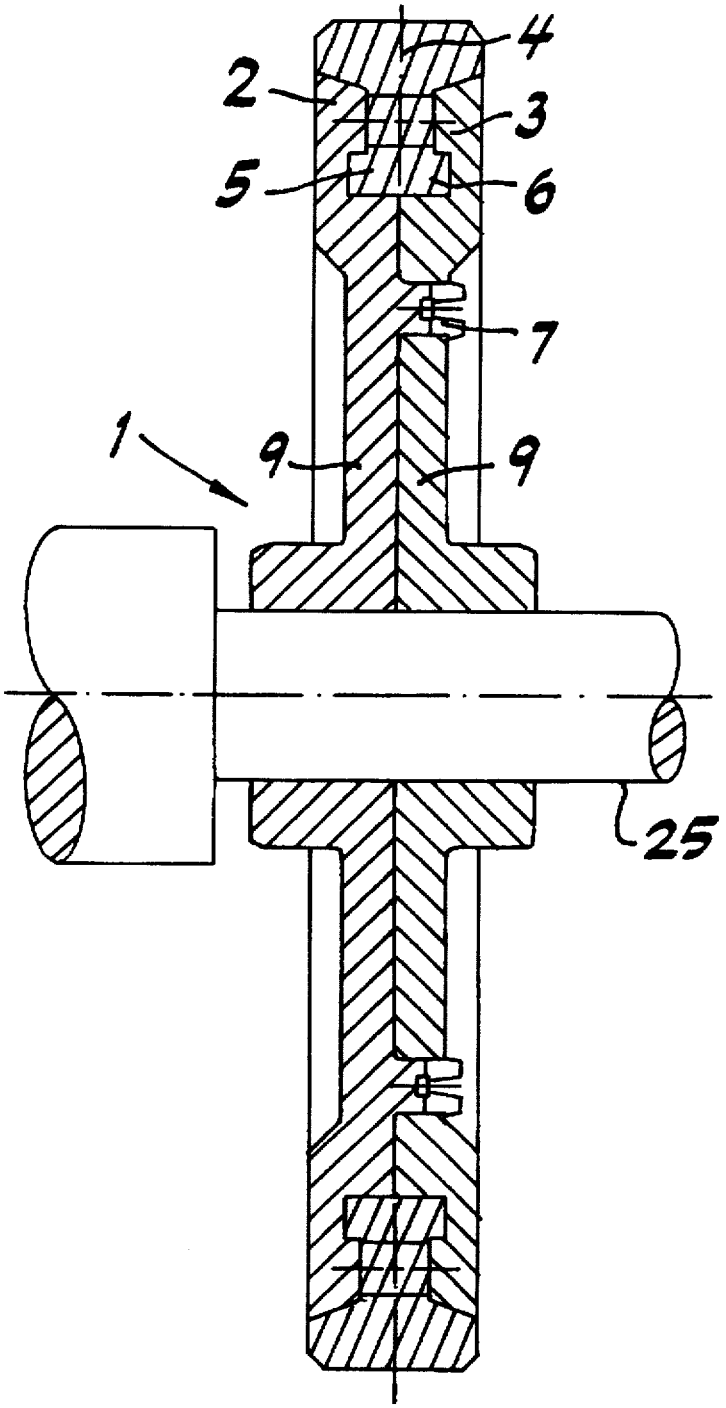
FIG. 1 is a cross-sectional view of a first embodiment of the rotor disk constructed according to the principles of present invention.
Figure 2:
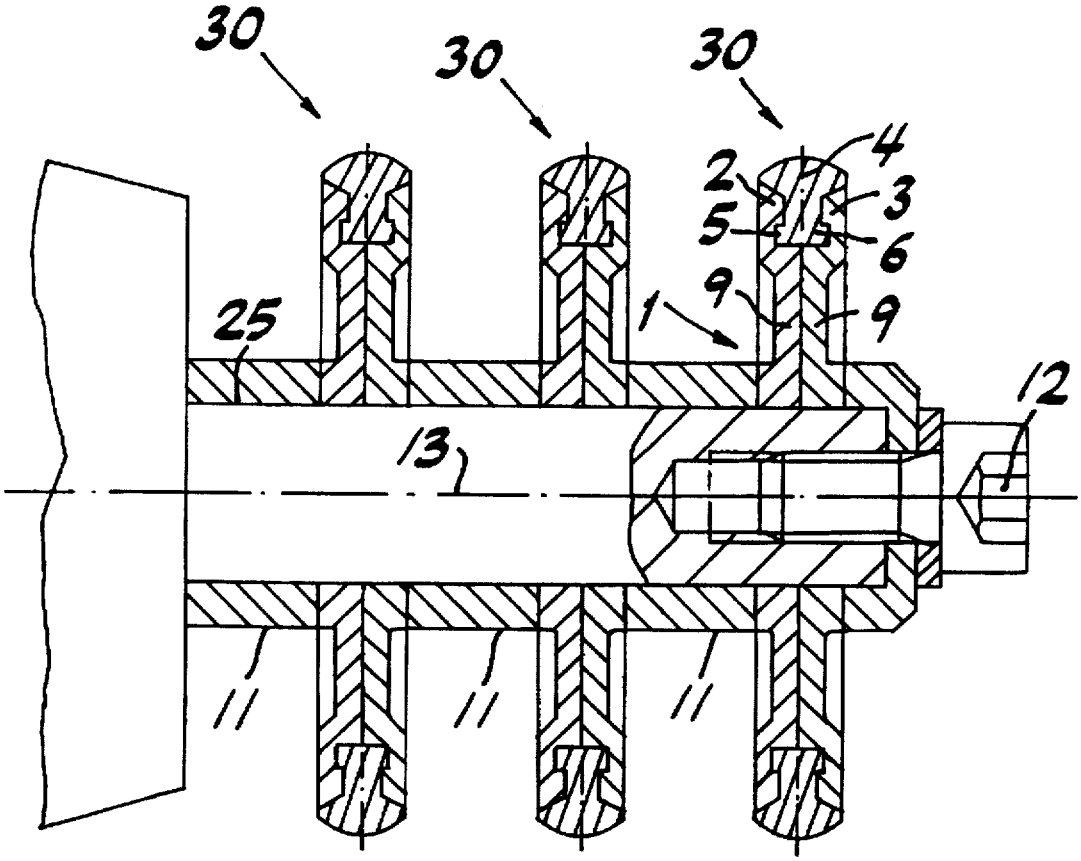
FIG. 2 is a cross-sectional view of a second embodiment of the invention.

FIGS. 1 and 2 illustrate a rotor disk 30 according to the present invention for a spinning machine. The rotor disk 30 illustrated in FIG. 2 may be used as a texturing disk. As shown in FIGS. 1 and 2, the hub ring 1 of the rotor disk 30 comprises a first carrier 2 and second carrier 3 which are generally identically constructed and arranged in a mirror image. The two carriers 2, 3 have an essentially C-shaped cross-section and are braced against each other at their radial projections 9. In the assembled state, the two carriers 2, 3, in the area of their radial periphery, collectively form the boundary of a grooved, undercut opening 5 that opens out radially for receiving a hammer-head-shaped projection 6 of the thrust ring 4, said projection 6 being circular on its inner peripheral side. The projection 6, under elastic prestressing, is held with form locking within the opening 5. In the illustrative embodiments shown here the thrust ring 4 is made of polyurethane. The two carriers 2, 3 are made of a polymer material.

Referring again to FIG. 1, the rotor disk 30 is held on the shaft 25 by a press fit. The two carriers 2, 3 are braced together in the axial direction by a clip connection 7, thereby preventing any separation of the carriers due to radial loads of the thrust ring 4. The carriers 2, 3 are held together in such a way that they can be detached from each other without damage when the thrust ring 4 is worn out. The clip-connection 7 braces the carriers 2, 3 with a force sufficient to hold the thrust ring but without adversely affecting the curvature and the true running of the outside diameter of the thrust ring 4. For measuring speed, the carriers 2, 3 of the rotor disk 30 can be provided, for example, with a reflector in the area of their front sides facing away from each other.

FIG. 2 illustrates an arrangement of rotor disks in which three of the rotor disks 30 according to the present invention are secured on a shaft 25 by a sliding fit. Each rotor disk 30 is maintained at a desired distance with respect to the other rotor disks 30 by means of spacers 11. The rotor disks 30, which are designed to function as texturing disks, are braced against each other in the axial direction by the clamping bolt 12.

Figure 3:
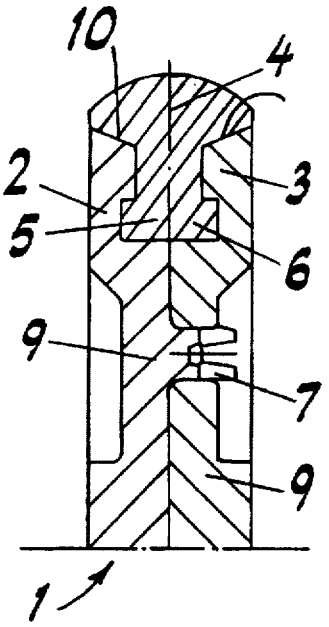
FIG. 3 is a cross-sectional view of the first and second carriers employed in the embodiment of FIG. 2.

Referring to FIG. 3, an enlarged, cut-away portion from the area of the opening 5 of the two carriers 2, 3 and the projection 6 of a portion of the thrust ring 4 is shown. It can be seen that the two carriers 2, 3, viewed in cross-section, have radially external contact surfaces 10 which together form the shape of a V. In this connection, it is an advantage that a radial prestressing is introduced in the thrust ring 4 because of the bracing of the first and second carriers 2, 3 in the axial direction. The V-shaped contact surfaces 10 of the first and second carriers 2, 3 form an angle of preferably 15° with the axis of rotation 13. The bracing provided by the radial projection 9, in cooperation with the grooved undercut opening 5 prevent the thrust rings from breaking contact with the V-shaped contact surface 10 of the carriers 2, 3.

Figure 4:
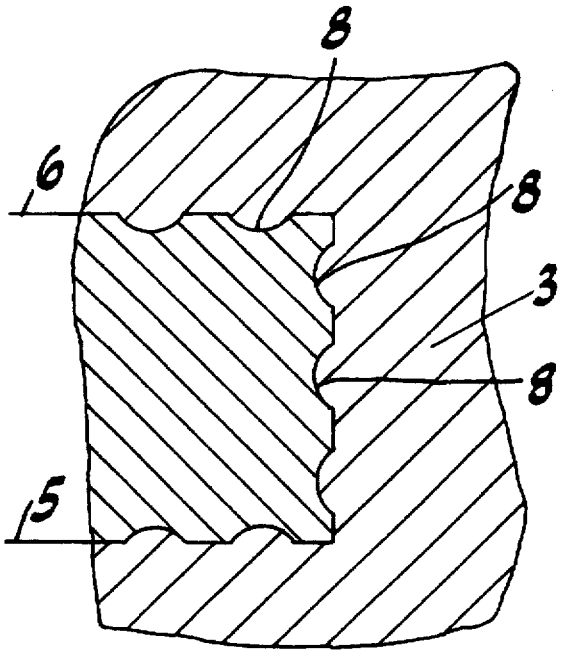
FIG. 4 is a cross-sectional view of a portion of one of the carriers illustrating the knobbed, surface profiling in a third embodiment of the present invention.

In FIG. 4 a cut-away portion from the second carrier 3 is shown which illustrates the surface profiling 8 in the area of the opening 5. This surface profiling 8 enlarges the contact surface in the area of the opening 5 and is designed as an anti-rotation element in order to hold the projection 6 of the thrust ring 4 with form locking within the opening 5. The thrust ring 4 is elastically deformed in the area of the knobbed surface profiling 8.

Though the present invention has been described with reference to specific embodiments selected for the purpose of illustration, it should be understood that numerous modifications could be applied by those skilled in the art without departing from the basic concept and scope of the present invention.

What is claimed is:

1. A rotor disk for a spinning machine comprising:

a hub ring having a first carrier and a second carrier wherein the first and second carriers are identically constructed and are arranged in a mirror image; and a thrust ring, wherein the hub ring is joined radially externally in a rotationally fixed manner to the thrust ring, the hub ring and the thrust ring being fastened together so that they can be detached non-destructively, and wherein the first and second carriers in the area of their periphery jointly from an opening when assembled for receiving the thrust ring, the boundary of the opening being grooved and undercut, and the thrust ring having at least one hammer-head-shaped projection pointing radially inwardly and arranged in the opening with form locking and under elastic prestressing, the surfaces of the first and second carriers bordering the opening being provided at least partially with a knobbed surface profile which helps prevent relative rotation between the carriers and the thrust ring.

2. The rotor disk as set forth in claim 1, wherein the thrust ring is polyurethane.

3. The rotor disk as set forth in claim 2, wherein the first and second carriers are held together by a fixing device.

4. The rotor disk as set forth in claim 1, wherein the first and second carriers are made of a polymer which is stable at approximately 150° C. to 250° C. and has an elastic modulus of approximately 17 GPa to 20 GPa and a maximum elongation of approximately 2.4%.

5. The rotor disk as set forth in claim 1, wherein the first and second carriers are held together by a fixing device.

6. The rotor disk as set forth in claim 1, wherein the thrust ring is an injection molded material.

7. The rotor disk as set forth in claim 1, wherein the rotor disk is a texturing disk.

8. A rotor disk for a spinning machine comprising:

a hub ring having a first carrier and a second carrier wherein the first and second carriers are generally identically constructed and are arranged in a mirror image, wherein the first and second carriers in the area of their periphery jointly form an opening when detachably assembled, the boundary of the opening being grooved and undercut, the surfaces of the first and second carriers bordering the opening being provided at least partially with a knobbed surface which engages a thrust ring.

9. The rotor disk as set forth in claim 1, wherein the fixing device is a clip-connection.

10. The rotor disk as set forth in claim 8, further comprising the thrust ring made of a polyurethane material, wherein the hub ring is joined radially externally in a rotationally fixed manner to the thrust ring, the hub ring and the thrust ring being fastened together so that they can be detached non-destructively, the thrust ring having at least one hammer-head-shaped projection pointing radially inwardly and arranged in the opening with form locking and under elastic prestressing.

11. A rotor disk for a spinning machine comprising:

a hub ring having a first carrier and a second carrier wherein the first and second carriers are identically constructed and are arranged in a mirror image; and a thrust ring for manipulating extruded threads, wherein the hub ring is joined radially externally in a rotationally fixed manner to the thrust ring, the hub ring and the thrust ring being fastened together so that they can be detached non-destructively and so that the curvature and true running of the outside diameter of the thrust ring are not adversely affected.

* * * * *